US006589022B2

(12) United States Patent
Yokomachi et al.

(10) Patent No.: US 6,589,022 B2
(45) Date of Patent: Jul. 8, 2003

(54) COMPRESSOR HAVING A SEAL COOLING STRUCTURE IN WHICH ALL REFRIGERANT FLUID SUPPLIED TO THE COMPRESSOR IS USED TO COOL COMPRESSOR SHAFT SEALS

(75) Inventors: Naoya Yokomachi, Kariya (JP); Takeshi Yamada, Kariya (JP); Masakazu Murase, Kariya (JP); Toshiro Fujii, Kariya (JP); Tatsuya Koide, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/964,297

(22) Filed: Sep. 26, 2001

(65) Prior Publication Data

US 2002/0041809 A1 Apr. 11, 2002

(30) Foreign Application Priority Data

Oct. 10, 2000 (JP) ..... 2000-308861
Jan. 15, 2001 (JP) ..... 2001-006529

(51) Int. Cl.[7] ..... F04B 1/26

(52) U.S. Cl. ..... 417/222.2; 417/269; 417/277; 277/366; 277/367

(58) Field of Search ..... 417/222.2, 269, 417/277; 277/358, 361, 500, 506, 366, 367, 392

(56) References Cited

U.S. PATENT DOCUMENTS 6,123,514 A * 9/2000 Kawaguchi et al. ..... 169/16
2002/0015645 A1 * 2/2002 Yamada et al. ..... 417/222.2

FOREIGN PATENT DOCUMENTS

| | | |
|---|---|---|
| EP | 0 926 342 A2 | 6/1999 |
| JP | A-10-26092 | 1/1998 |
| JP | 2001-003860 A | 1/2001 |

* cited by examiner

*Primary Examiner*—Charles G. Freay
*Assistant Examiner*—Emmanuel Sayoc
(74) *Attorney, Agent, or Firm*—Woodcock Washburn LLP

(57) ABSTRACT

The compressor has a cooling structure to effectively cool a shaft seal device interposed between a housing of the compressor and a rotary shaft. The front housing has a through-hole through which the rotary shaft extends, and the shaft seal device is arranged in the through-hole. A passage (suction passage portion) is connected to the thorough-hole. An inlet from a portion of the passage to the through-hole is arranged right above the rotary shaft, and an outlet from the through-hole to a portion of the passage is arranged right below the rotary shaft. The passage is connected to a suction pressure region outside the compressor and to the suction chamber via the through-hole.

12 Claims, 8 Drawing Sheets

COMPRESSOR HAVING A SEAL COOLING STRUCTURE IN WHICH ALL REFRIGERANT FLUID SUPPLIED TO THE COMPRESSOR IS USED TO COOL COMPRESSOR SHAFT SEALS

BACKGROUND OF THE INVENTION

1. Field of the Invention

The present invention relates to a cooling structure in a compressor in which a compression member delimiting a compression chamber is moved according to the rotation of a rotary shaft so that a refrigerant is sucked from a suction chamber into the compression chamber, by the motion of the compression member, and discharged from the compression chamber, and a shaft seal means is arranged between the housing of the compressor and the rotary shaft so as to seal the inside of the housing of the compressor.

2. Description of the Related Art

In the compressor disclosed in Japanese Unexamined Patent Publication No. 10-26092, in order to lubricate the shaft seal means arranged between the housing and the rotary shaft, a communication port is branched from the intermediate portion of the suction refrigerant passage and connected to the shaft seal means. A portion of the refrigerant flowing in the suction refrigerant passage arrives at the shaft seal means via the communication port, so that the lubricant flowing together with the refrigerant lubricates the shaft seal means.

In the compressor disclosed in Japanese Unexamined Patent Publication No. 11-241681, there is provided a decompression passage in the rotary shaft, which reaches the shaft seal means, and the decompression passage is decompressed by the sucking action of a fan rotating integrally with the rotary shaft. The region in which the shaft seal means is arranged is connected to the control pressure chamber in which the swash plate is accommodated. The refrigerant flows from the control pressure chamber into the region of the shaft seal means by decompression in the decompression passage. Therefore, the lubricant flowing together with the refrigerant lubricates the shaft seal means.

The sealing function of the shaft seal means early deteriorates in a high temperature environment. Therefore, it is important not only to lubricate but also to cool the seal means. In the compressor disclosed in Japanese Unexamined Patent Publication No. 10-26092, the communication port reaches the region in which the shaft seal means is arranged. Therefore, lubricant that has flowed into the communication port does not flow smoothly. When lubricant does not flow smoothly, the shaft seal means can not be efficiently cooled.

In the compressor disclosed in Japanese Unexamined Patent Publication No. 11-241681, the refrigerant that flows from the control pressure chamber into the region in which the shaft seal means is arranged is returned into the control pressure chamber via the decompression passage in the rotary shaft. Therefore, lubricant flows smoothly in the region in which the shaft seal means is arranged. However, the temperature in the control pressure chamber is high, and the temperature of the lubricant that flows into the region in which the shaft seal is arranged is also high. Therefore, although it is necessary to provide a decompression means (for example, a fan mechanism) for generating a pressure difference between the region in which the shaft seal means is arranged and the control pressure chamber, the shaft seal means cannot be effectively cooled.

SUMMARY OF THE INVENTION

It is an object of the present invention to effectively cool a shaft seal device arranged between a housing and a rotary shaft for sealing the inside of the housing of the compressor.

In order to accomplish the above object, the present invention provides a compressor comprising a housing having a suction chamber, a discharge chamber and at least one compression chamber, at least one compression member delimiting the at least one compression chamber, a rotary shaft supported by the housing to move the compression member so that a refrigerant is sucked from the suction chamber into the compression chamber and discharged from the compression chamber into the discharge chamber and a shaft seal device arranged between the housing and the rotary shaft to seal the inside of the housing of the compressor, an accommodation space accommodating the shaft seal device, and a passage connected to the accommodation space to allow the refrigerant to come into contact with the shaft seal device, wherein the passage forms a passageway from a suction pressure region outside the housing to the suction chamber via the accommodation space, and an inlet from a portion of the passage arranged on the upstream side of the accommodation space to the accommodation space and an outlet from the accommodation space to a portion of the passage arranged on the downstream side of the accommodation space are arranged separately from each other.

The refrigerant flowing from the suction pressure region located outside the entire housing flows from the passage portion on the upstream side into the accommodation space via the inlet and flows out from the accommodation space into the passage portion on the downstream side via the outlet. In the accommodation space, the inlet and the outlet are separately arranged from each other, and therefore, the lubricant smoothly flows in the accommodation space. Further, the temperature of the refrigerant in the suction pressure region outside the housing of the compressor is low, and the temperature of the lubricant flowing together with the refrigerant of low temperature is also low. Accordingly, the shaft seal device accommodated in the accommodation chamber can be effectively cooled.

Preferably, the inlet is located above the rotary shaft, and the outlet is located below the rotary shaft.

A portion of the lubricant, which flows from the inlet into the accommodation space, flows downward along the shaft seal device and cools the shaft seal device. The lubricant, which has cooled the shaft seal device while it is flowing downward along the shaft seal means, flows out from the outlet. The inlet is arranged above the rotary shaft and the outlet is arranged below the rotary shaft, and therefore, the lubricant smoothly flows along the shaft seal device.

Preferably, the rotary shaft extends through the front housing composing the housing of the compressor and protrudes outside the housing, the shaft seal device is arranged between the rotary shaft and the front housing, the passage extends in the wall of the front housing and is connected to the accommodation space, and the inlet of the passage in the entire housing is arranged in the front housing.

The length of the passage from the outside of the housing to the accommodation space is short, and therefore, an increase in the temperature of the refrigerant can be suppressed while the refrigerant flows from the outside of the housing into the accommodation space.

Preferably, the compressor is a variable displacement piston type compressor comprising said housing including a front housing and a cylinder coupled to the front housing and having a plurality of cylinder bores around the rotary shaft, pistons accommodated in the cylinder bores as the compression members to delimit the compression chambers, a tiltable swash plate arranged in a control chamber in the front housing and rotated by the rotary shaft, so that a tilt angle of the swash plate is changed by adjusting a pressure in the control pressure space, the accommodation chamber and the suction chamber being separated from each other by the control pressure chamber, and the cylinder, and a second shaft seal device to shut off the communication between the accommodation space and the control pressure chamber along the circumferential surface of the rotary shaft.

The present invention is preferably applied to a variable displacement piston type compressor in which the accommodation space and the suction chamber are separated from each other so that the control pressure chamber and the cylinder can be interposed between them.

Preferably, the shaft seal device comprises a mechanical seal. The mechanical seal is excellent in the pressure-resistance property.

Preferably, the shaft seal device comprises a lip type seal. When the lip seal is used, the shaft sealing structure can be composed at low cost and further it is possible to provide an excellent oil-seal property by the lip seal.

BRIEF DESCRIPTION OF THE DRAWINGS

The present invention will become more apparent from the following description of the preferred embodiments, with reference to the accompanying drawing, in which.

DESCRIPTION OF THE PREFERRED EMBODIMENTS

Referring to FIGS. 1 to 4, the first embodiment of the present invention will be explained as follows.

Figure 1:
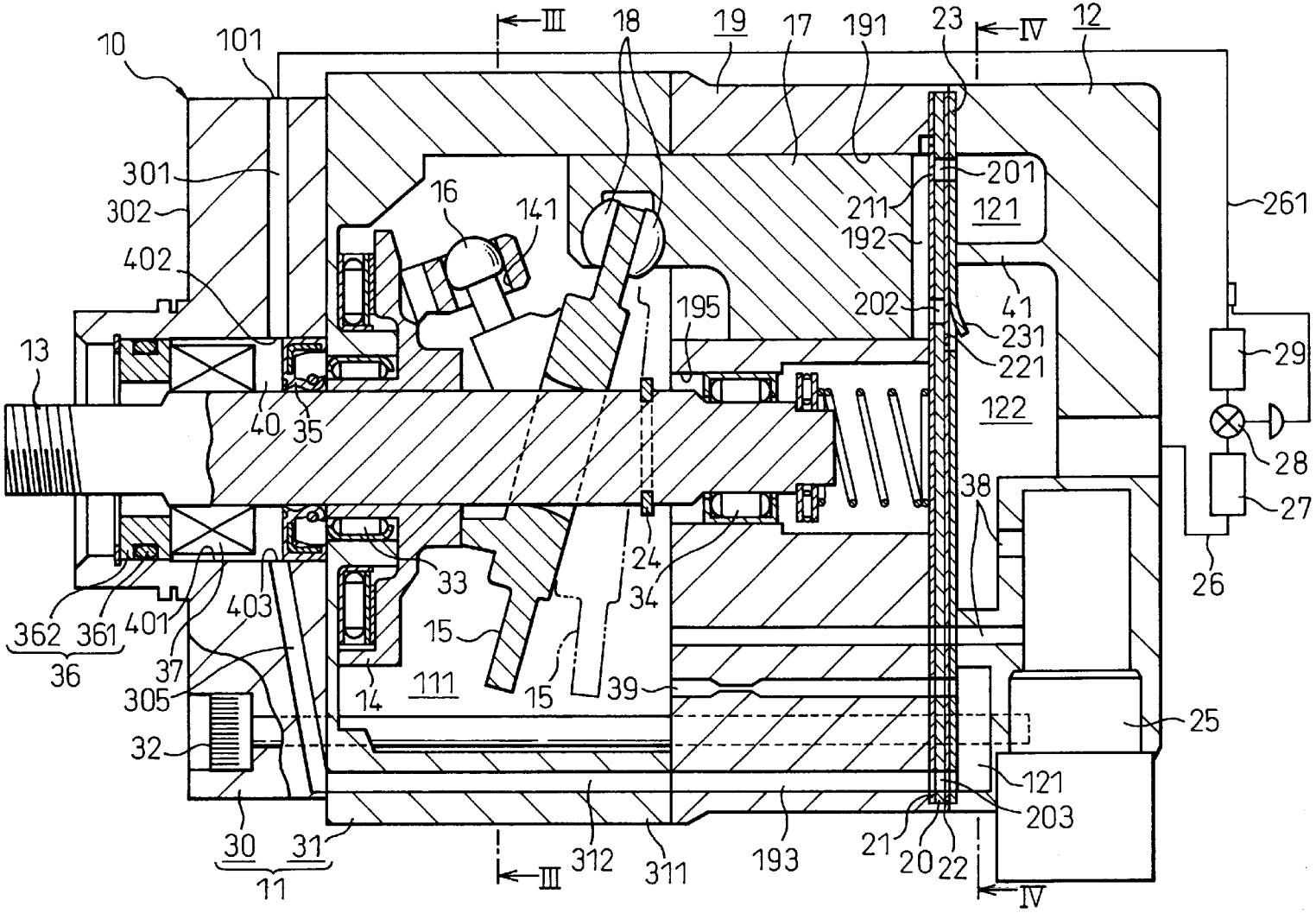
FIG. 1 is a cross-sectional side view showing an overall compressor of the first embodiment.

FIG. 1 is a view showing the inner structure of a variable displacement piston type compressor. The entire housing 10 of the compressor comprises a front housing 11, a rear housing 12 and a cylinder 19, with these components coupled to each other. The front housing 11 further comprises a support housing 30 and a chamber forming housing 31. The support housing 30, the chamber forming housing 31, the cylinder 19 and the rear housing 12 are fastened and fixed by bolts 32 which extend through the support housing 30, the chamber forming housing 31 and the cylinder 19 and are threaded to the rear housing 12.

A rotary shaft 13 is supported by the chamber forming housing 31, which forms a control pressure chamber 111, and the cylinder 19. A rotation support body 14 is attached to the rotary shaft 13 in the control pressure chamber 111. A radial bearing 33 is arranged between the rotation support body 14 and the chamber forming housing 31. A radial bearing 34 is arranged between the end section of the rotary shaft 13, which is inserted into the support hole 195 formed in the cylinder 19, and the circumferential surface of the support hole 195. The chamber forming housing 31 supports the rotation support body 14 and the rotary shaft 13 via the radial bearing 33 so that the rotation support body 14 and the rotary shaft 13 can be integrally rotated. The cylinder 19 rotatably supports the rotary shaft 13 via the radial bearing 34.

The rotary shaft 13 protrudes to the outside of the compressor through a through-hole 40 in the support housing 30, and a rotary drive power is given to the rotary shaft 13 from an external drive source (for example, a vehicle engine). In the through-hole 40, a seal mechanism 36, a seal mechanism 37 and a seal mechanism 35 including a lip seal are arranged. The seal mechanism 36 comprises a seal ring 361, which contacts the circumferential surface 401 of the through-hole 40, and a support ring 362 which supports the seal ring 361.

Figure 2:
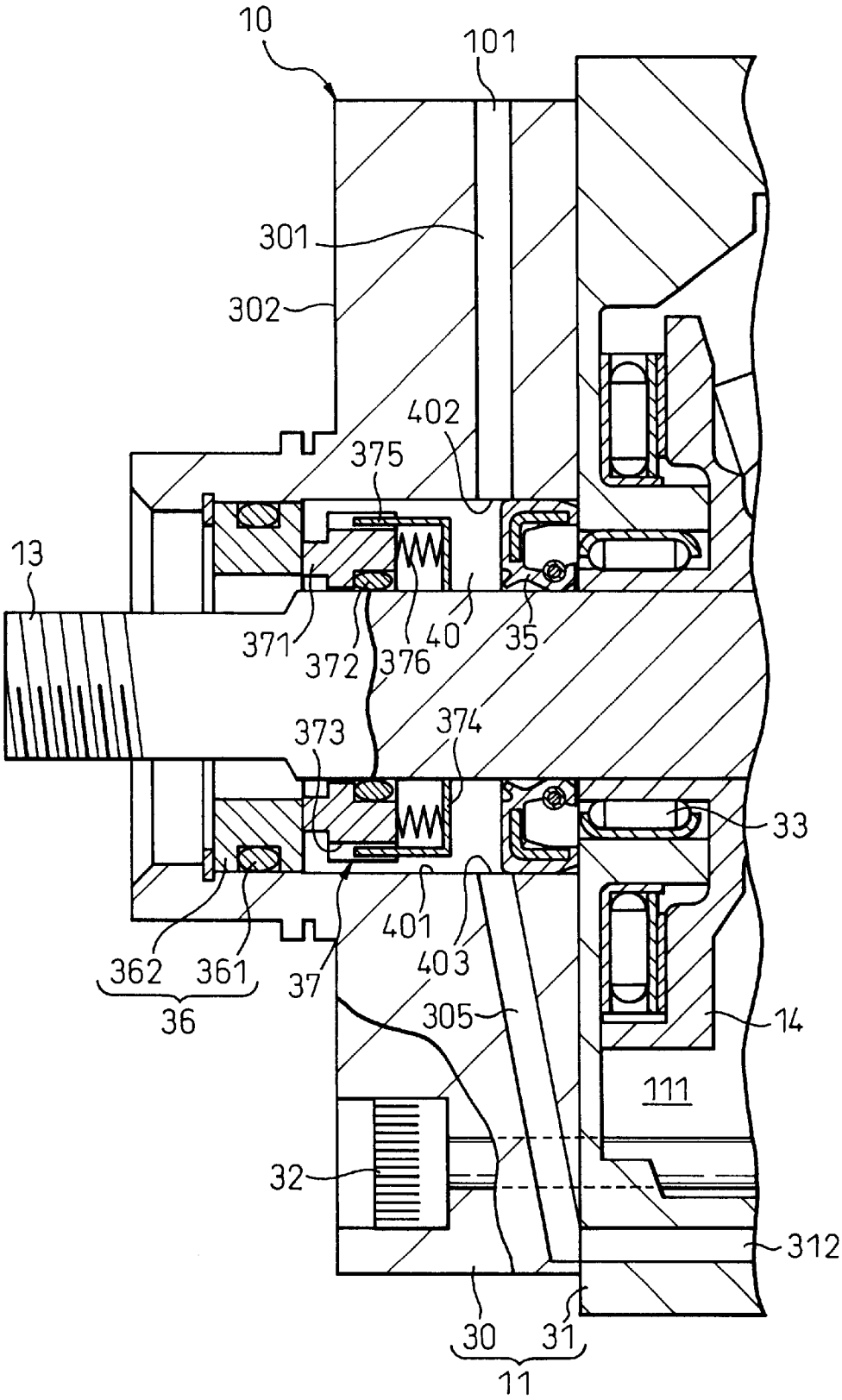
FIG. 2 is an enlarged cross-sectional side view showing a primary portion of the compressor of FIG. 1.

As shown in greater detail in FIG. 2, the seal mechanism 37 is provided with a slide ring 371 made of carbon, and the slide ring 371 is attached to the rotary shaft 13 via an O-ring 372 so that the slide ring 371 can be integrally rotated with the rotary shaft 13, and at the same time, the slide ring 371 contacts the end surface of the support ring 362. In the outer circumferential section of the slide ring 371, there is provided grooves 373. The seal mechanism 37 is provided with a support ring 374 capable of integrally rotating with the rotary shaft 13. The support ring 374 is provided with engaging pieces 375 which engage with the grooves 373. Also, a spring 376 is provided for urging the slide ring 371 onto the seal mechanism 36 side. Accordingly, the seal mechanism 37 comes into pressure contact with the support ring 362 of the seal mechanism 36 by the slide ring 371. The seal mechanism 37 and the seal mechanism 36 constitute a mechanical seal.

The seal mechanism 37 prevents leakage of the refrigerant from the through-hole 40 to the outside of the compressor along the circumferential surface of the rotary shaft 13. In order to tightly seal the inside of the housing 10, the seal mechanisms 36 and 37 constitute a shaft seal means which is interposed between the housing 10 and the rotary shaft 13. The seal mechanism 35 comes into contact with the circumferential surface of the rotary shaft 13. The seal mechanism 35 is a second shaft seal means for shutting off the communication between the through-hole 40 and the control pressure chamber 111 along the circumferential surface of the rotary shaft 13. The through-hole 40 becomes an accommodation space in which the seal mechanisms 36, 37 and 35 are accommodated.

Figure 3:
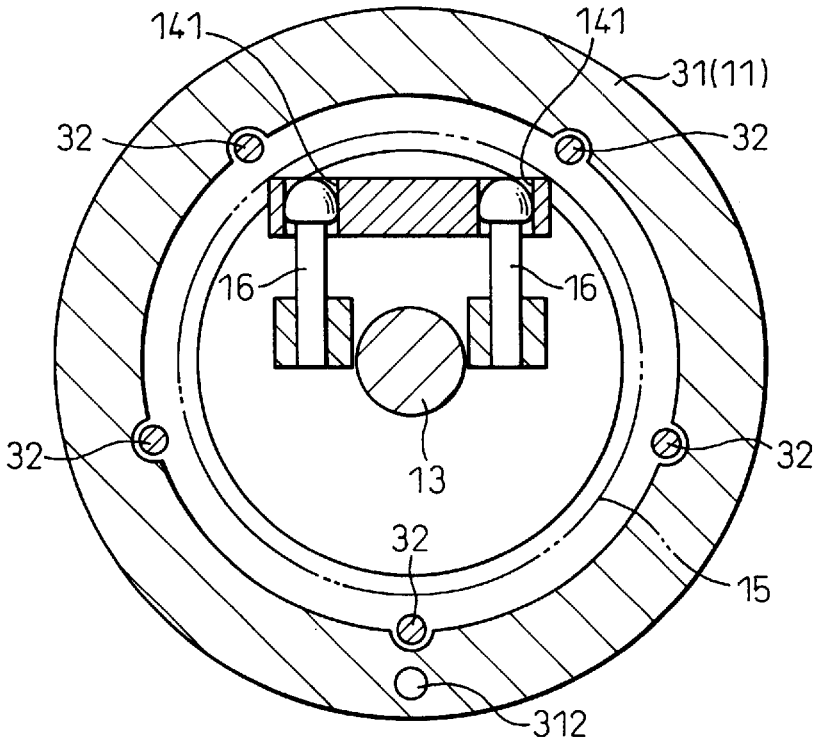
FIG. 3 is a cross-sectional view taken on line III—III in FIG. 1.

A swash plate 15 is tiltably supported by the rotary shaft 13 in such a manner that the swash plate 15 can slide in the axial direction of the rotary shaft 13. As shown in FIG. 3, a pair of guide pins 16 are attached to the swash plate 15. The guide pins 16 attached to the swash plate 15 are slidably inserted into guide holes 141 formed in the rotary support body 14. Since the guide holes 141 and the guide pins 16 are linked with each other, the swash plate 15 is tiltable in the axial direction of the rotary shaft 13 and rotatable integrally with the rotary shaft 13. The tilting motion of the swash plate 15 can be guided according to the sliding guide relationship between the guide holes 141 and the guide pins 16 and also according to the sliding support action of the rotary shaft 13.

Figure 4:
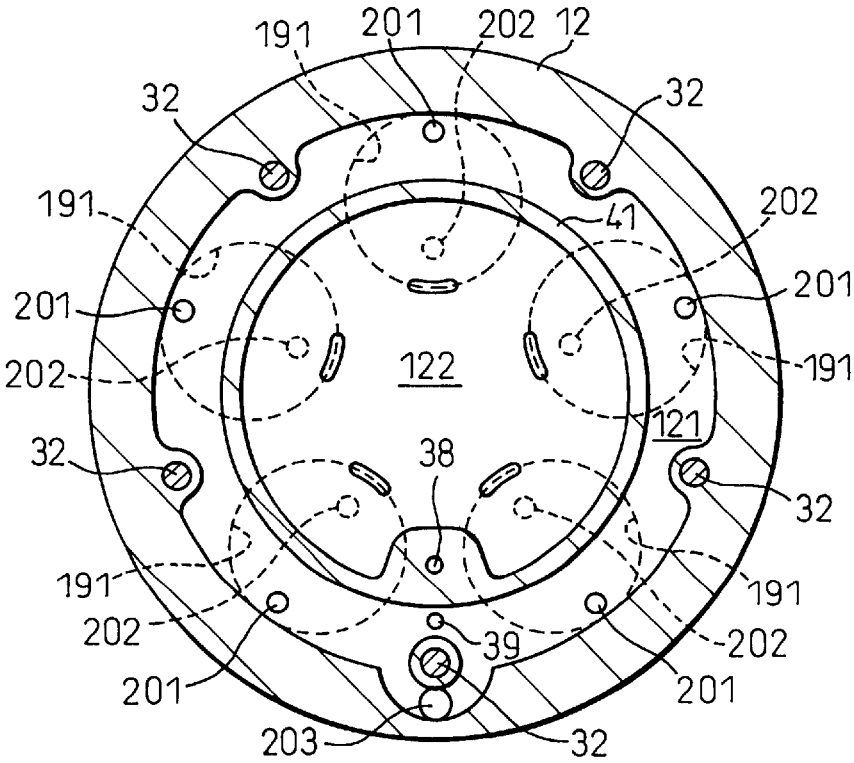
FIG. 4 is a cross-sectional view taken on line IV—IV in FIG. 1.

As shown in FIG. 1, in the cylinder block 19, there are provided a plurality of cylinder bores 191 around the rotary shaft 13 at regular angular intervals. In FIG. 1, only one cylinder bore 191 is shown, however, as shown in FIG. 4, five cylinder bores are arranged at regular angular intervals in this embodiment. In each cylinder bore 191, there is provided a piston 17 as a compression member. Each piston 17 delimits a compression chamber 192 in the cylinder bore 191. The rotary motion of the swash plate 15, which is integrally rotated with the rotary shaft 13, is converted into the reciprocating motion in the longitudinal direction of the pistons 17 via shoes 18, so that the pistons 17 can be reciprocated in the cylinder bore 191 in the longitudinal direction.

Between the cylinder 19 and the rear housing 12, there are provided a valve plate 20, a valve forming plates 21 and 22 and a retainer forming plate 23. As shown in FIG. 4, in the rear housing 12, there are provided a suction chamber 121 and a discharge chamber 122. The suction chamber 121 and the discharge chamber 122 are separated from each other by a separation wall 41, and the discharge chamber 122 is surrounded by the suction chamber 121.

Refrigerant in the suction chamber 121, which is a suction pressure region, pushes and opens the suction valves 211 in the valve forming plate 21 from suction port 201 in the valve plate 20 by the returning motion of the piston 17 (movement of the piston 17 from the right to the left in FIG. 1), and flows into the compression chambers 192. After the refrigerant flows into the compression chamber 192, it pushes and opens discharge valves 221 in the valve forming plate 22 from discharge ports 202 in the valve plate 20 by the reciprocating motion (movement of the piston 17 from the left to the right in FIG. 1) of the piston 17, and is discharged into the discharge chamber 122 which is a discharge pressure region. The discharge valves 221 come into contact with retainers 231 in the retainer forming plate 23, so that the degree of opening of the discharge valves 221 can be regulated.

The refrigerant is introduced from the discharge chamber 122 into the control pressure chamber 111 through a pressure supply path 38 connecting the discharge chamber 122 to the control pressure chamber 111. The refrigerant flows out from the control pressure chamber 111 into the suction chamber 121 through a pressure releasing path 39 connecting the control pressure chamber 111 to the suction chamber 121. On the pressure supply path 38, there is provided an electromagnetic type capacity control valve 25. The capacity control valve 25 is subjected to magnetizing and demagnetizing control of a controller (not shown). The controller controls magnetization and demagnetization of the capacity control valve 25 according to the detected compartment temperature which is obtained by a compartment temperature detector (not shown) to detect the compartment temperature in the vehicle and also according to a target compartment temperature which is set by a compartment temperature setting device (not shown). When the electric current is turned off, the capacity control valve 25 is open. When the electric current is turned on, the capacity control valve 25 is closed. That is, when the capacity control valve 25 is demagnetized, the refrigerant is introduced from the discharge chamber 122 into the control pressure chamber 111. When the capacity control valve 25 is magnetized, the refrigerant is not introduced from the discharge chamber 122 into the control pressure chamber 111. The capacity control valve 25 controls the supply of the refrigerant from the discharge chamber 122 into the control pressure chamber 111.

The tilt angle of the swash plate 15 is changed according to the pressure control to control the pressure in the control pressure chamber 111. When the pressure in the control pressure chamber 111 is increased, the tilt angle of the swash plate 15 is decreased. When the pressure in the control pressure chamber 111 is decreased, the tilt angle of the swash plate 15 is increased. When the refrigerant is supplied from the discharge chamber 122 into the control pressure chamber 111, the pressure in the control pressure chamber 111 is increased. When the supply of refrigerant from the discharge chamber 122 into the control pressure chamber 111 is stopped, the pressure in the control pressure chamber 111 is decreased. That is, the tilt angle of the swash plate 15 is controlled by the capacity control valve 25.

The maximum tilt angle of the swash plate 15 is regulated by the contact between the swash plate 15 and the rotation support body 14. The minimum tilt angle of the swash plate 15 is regulated by the contact between a circlip 24 on the rotary shaft 13 and the swash plate 15.

As shown in FIG. 2, a suction passage including passage portions 301 and 305 is formed in the support housing 30 in communication with the through-hole 40. An inlet 101 of the suction passage portion 301 into the housing 10 is arranged at the uppermost position on the outer circumferential surface of the support housing 30. An inlet 402 from the suction passage portion 301 to the through-hole 40 is arranged at the uppermost position on the circumferential surface 401 of the through-hole 40. An outlet 403 from the through-hole 40 to the suction passage portion 305 is arranged at the lowermost position of the circumferential surface 401 of the through-hole 40. That is, the inlet 402 is located right above the rotary shaft 13, and the outlet 403 is located right below the rotary shaft 13.

As shown in FIG. 1, suction passage portions 312 and 193 are formed at a position close to the lowermost position of the circumferential wall 311 of the chamber forming housing 31 and also at a position close to the lowermost position of the cylinder 19. The suction passage portion 312 is connected to the suction passage portion 305 at the joining part of the support housing 30 and the chamber forming housing 31. The suction passage portion 312 is connected to the suction passage portion 193 at the joining part of the chamber forming housing 31 and the cylinder 19.

A communicating port 203 is formed at a position close to the lowermost positions of the valve plate 20, the valve forming plates 21 and 22 and the retainer forming plate 23. The communicating port 203 is connected to the suction passage portion 193 and to the suction chamber 121. The suction passage portion 301 composes a passage portion on the upstream side of the through-hole 40 which is an accommodation space. The suction passage portions 305, 312 and 193 and the communicating port 203 compose passage portions on the downstream side of the through-hole 40.

The discharge chamber 122 and the suction chamber 121 are connected to each other via an external refrigerant circuit 26, the suction passage including the suction passage portions 301, 305, 312, 193 and the communicating port 203. After the refrigerant flows out from the discharge chamber 122 into the external refrigerant circuit 26, it returns to the suction chamber 121 via a condenser 27, an expansion valve 28, an evaporator 29, and the suction passage 301, 305, 312, 193 and 203.

The following effects can be provided by the first embodiment.

(1-1) A path 261 of the external refrigerant circuit 26 from the evaporator 29 to the inlet 101 of the suction passage portion 301 is a suction pressure region outside the compressor. Temperature of the refrigerant subjected to the heat exchanging action by the evaporator 29 is low. Therefore, the temperature of the lubricant flowing together with the refrigerant passing in the evaporator 29 is also low. The refrigerant, which flows from the external refrigerant circuit 26 into the suction passage portion 301, passes the through-hole 40 and flows into the suction chamber 121 via the suction passage portions 305, 312 and 193. A portion of the lubricant, the temperature of which is low, is attached to the seal mechanisms 36, 37 and 35 and lubricates and cools them. A portion of the lubricant, the temperature of which is low, comes into contact with the circumferential surface of the rotary shaft 13 and cools a portion of the rotary shaft 13 close to the through-hole 40. Since the inlet 402 and the outlet 403 of the through-hole 40 are arranged separately from each other, the refrigerant flows smoothly in the through-hole 40. Therefore, the lubricant, the temperature of which is low, flowing together with the refrigerant in the through-hole 40, flows smoothly. Accordingly, the shaft seal mechanisms 36, 37 and 35, which are the shaft seal means accommodated in the through-hole 40, can be effectively cooled.

(1-2) A portion of the lubricant, which flows from the inlet 402 right above the rotary shaft 13 into the through-hole 40, flows downward along the seal mechanisms 36, 37 and 35 and cools the seal mechanisms 36, 37 and 35. The lubricant, which has cooled the seal mechanisms 36, 37 and 35 while it is flowing downward along the seal mechanisms 36, 37 and 35, flows out from the outlet 403 right below the rotary shaft 13. Since the inlet 402 is arranged above the upper portion of the rotary shaft 13 and the outlet 403 is arranged below the lower portion of the rotary shaft 13, the lubricant flows downward along the seal mechanisms 36, 37 and 35 not only by the action of the refrigerant current but also by the weight of the lubricant itself. Since the lubricant flows downward by the weight of the lubricant itself, the lubricant can smoothly flow into the through-hole 40.

(1-3) The suction passage 301 and 305 extends in the wall of the front housing 11 supporting the seal mechanisms 35 and 36, and the inlet 101 of the suction passage portion 301 in the housing 10 is provided on the outer circumferential surface of the front housing 11. The shorter the length of the suction passage portion 301 from the external refrigerant circuit 26 to the through-hole 40, the more strongly the increase in the temperature of the lubricant, from the external refrigerant circuit 26 to the through-hole 40 via the suction passage portion 301, can be suppressed. Since the inlet 101 is arranged on the outer circumferential surface of the front housing 11, the length of the suction passage portion 301 from the path 261, which is a suction pressure region outside the housing 10, to the through-hole 40, is shortened.

(1-4) A portion close to the outer end surface 302 (shown in FIG. 1) of the support housing 30 is a space in which a portion (for example, an electromagnetic clutch) of the power transmission mechanism for transmitting the power from the external drive source to the rotary shaft 13 is arranged. Therefore, it is difficult for the inlet 101 of the suction passage portion 301 to be arranged on the outer end surface 302. The outer circumferential surface of the support housing 30, especially a portion of the outer circumferential surface of the support housing 30 right above the rotary shaft 13 is preferably used as a space in which the inlet 101 is arranged.

(1-5) Since the support housing 30 and the chamber forming housing 31 are joined to each other and constitute the front housing 11, the suction passage portions 301, 305 and 312, which pass in the wall of the front housing 11, can be easily formed.

(1-6) The shaft seal means 36 and 37 comprises a mechanical seal, which is excellent in the pressure-resistance property. Accordingly, in the case where carbon dioxide is used as refrigerant, the pressure of which is higher than that in the case where chlorofluorocarbons is used as refrigerant, a shaft seal mechanism having a high pressure-resistance property can be preferably provided.

Figure 5:
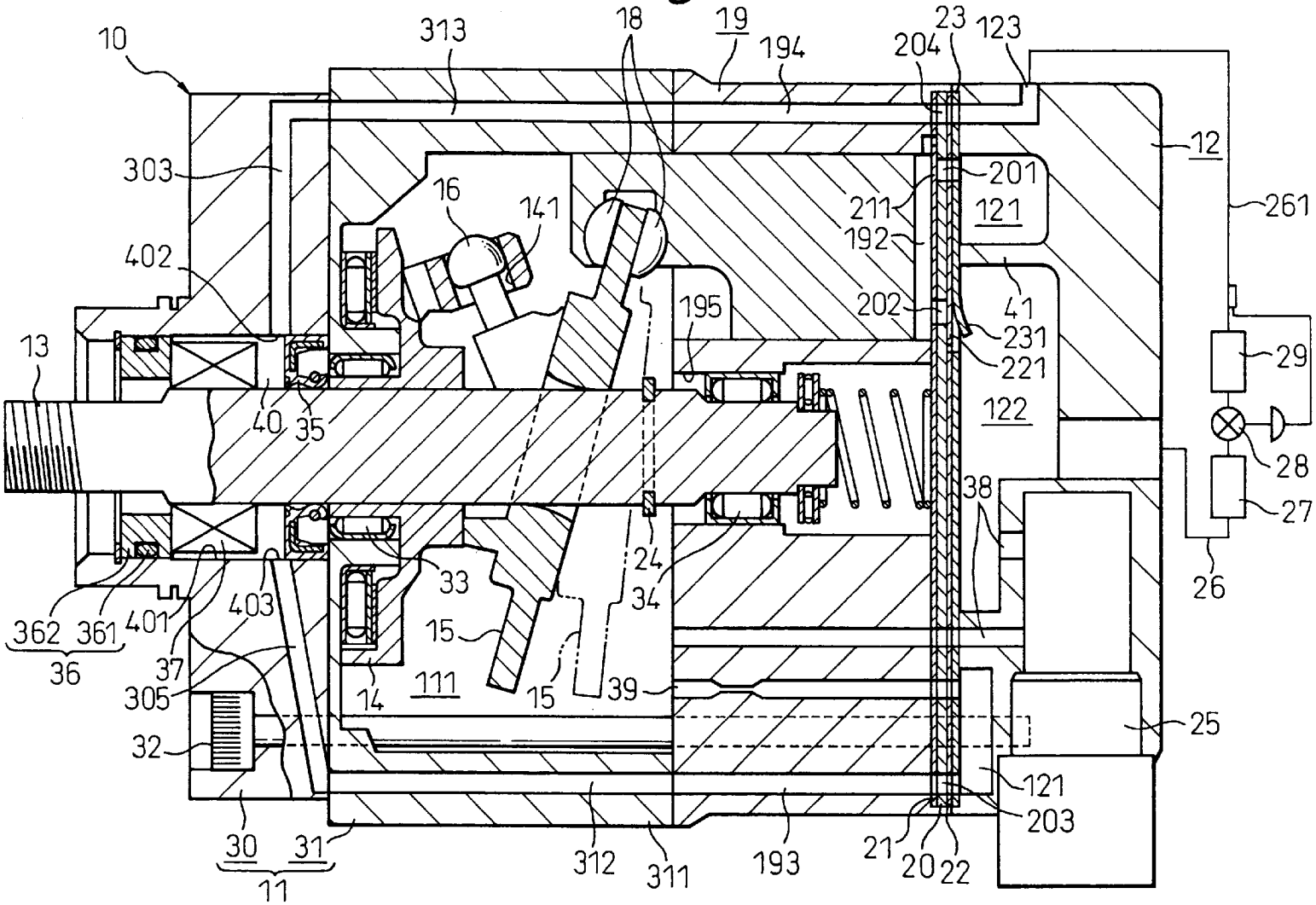
FIG. 5 is a cross-sectional side view showing a compressor of the second embodiment.

Next, the second embodiment shown in FIG. 5 will be explained below. Like reference characters are used to indicate like parts of the first embodiment.

An introduction passage 123 is formed in the rear housing 12. The introduction passage 123 is connected to the path 261. A communication port 204 is formed in the valve plate 20, the valve forming plates 21 and 22 and the retainer forming plate 23 in communication with the introduction passage 123. Suction passage portions 194 and 313 are respectively formed in a portion close to the uppermost position of the outer circumferential section of the cylinder 19 and also in a portion close to the uppermost position of the circumferential wall 311 of the chamber forming housing 31. The suction passage portion 194 is connected to the communication port 204, and the suction passage portion 194 and 313 are connected to each other at a part joining the chamber forming housing 31 and the cylinder 19. Suction passage portions 303 and 305 of the support housing 30 are connected to the suction passage portions 313 and 312 respectively.

In the second embodiment in which the introduction passage 123, the communication port 204 and the suction passage portions 194, 313 and 301 compose a passage portion on the upstream side and also the suction passage portions 305, 312 and 193 and the communication port 203 compose a passage portion on the downstream side, the same effects as those described in items (1-1), (1-2), (1-5) and (1-6) of the first embodiment can be provided.

Next, the third embodiment shown in FIGS. 6 and 7 will be explained below. Like reference characters are used to indicate like parts of the second embodiment.

Figure 7:
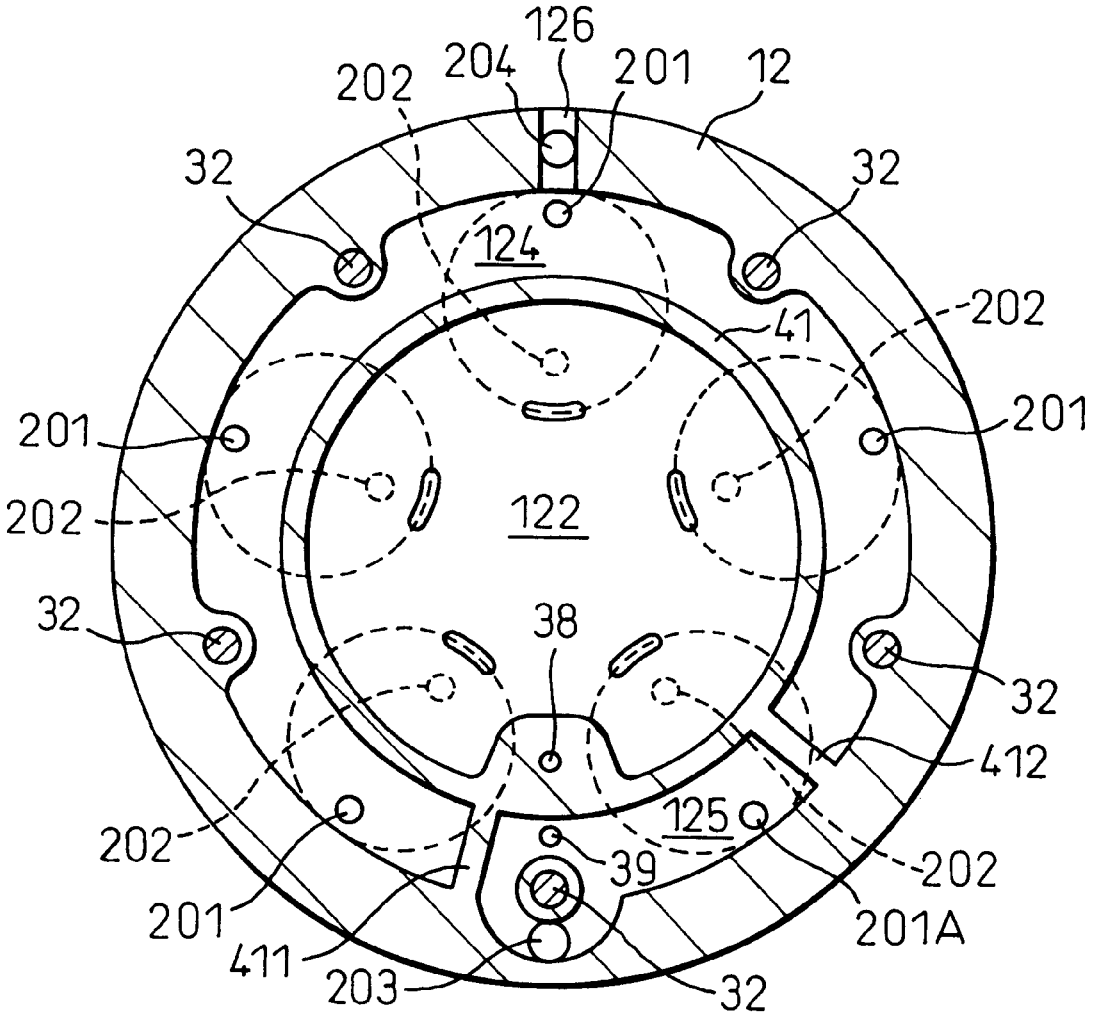
FIG. 7 is a cross-sectional view taken on line VII—VII in FIG. 6.

As shown in FIG. 7, in the rear housing 12, a first suction chamber 124 and a second suction chamber 125 are formed, being divided by separation walls 41, 411 and 412. The second suction chamber 125 is communicated with only a specific suction port 201A which is one of the plurality of suction ports 201. The first suction chamber 124 is communicated with the suction ports 201 except for the suction port 201A.

Figure 6:
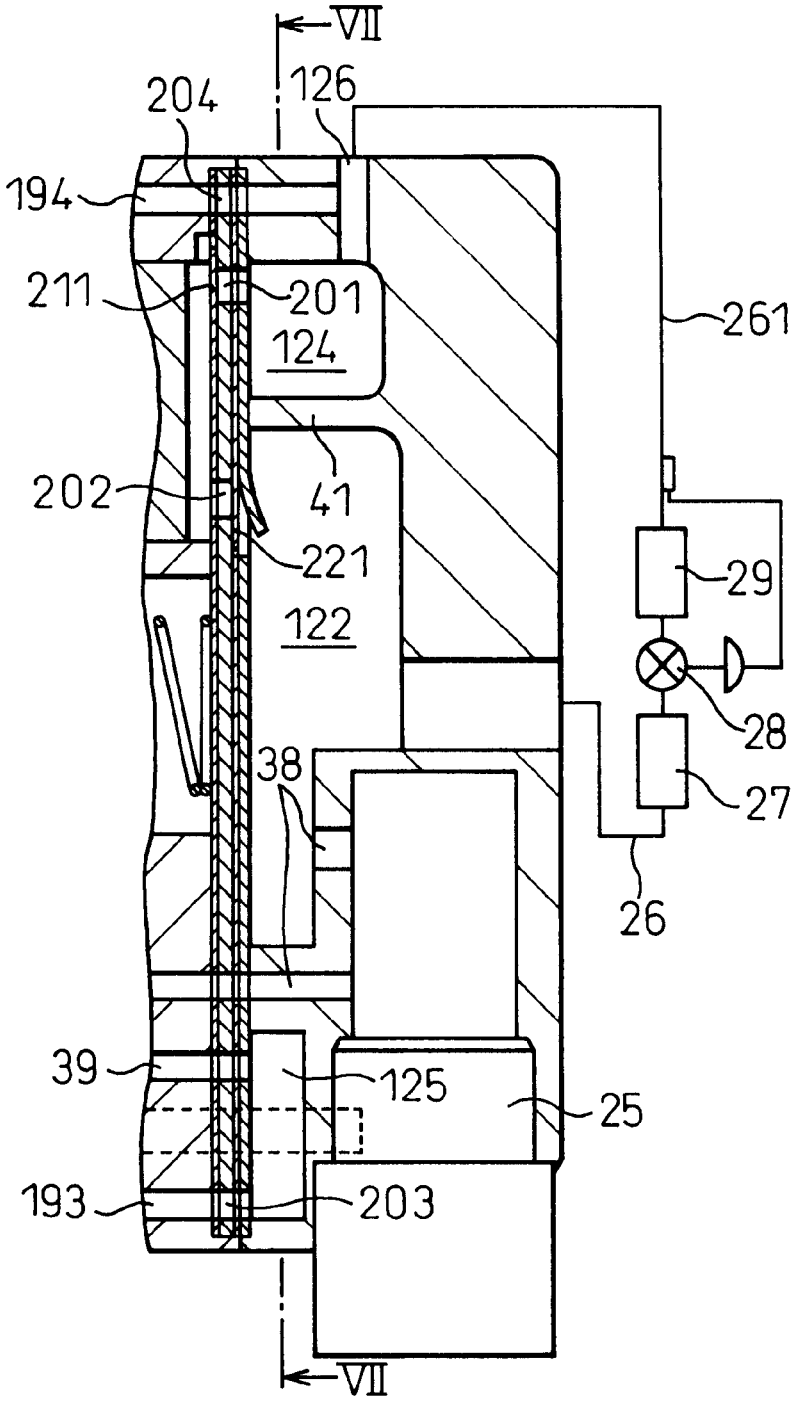
FIG. 6 is a cross-sectional side view showing a compressor of the third embodiment.

As shown in FIG. 6, the first suction chamber 124 is connected to the external refrigerant circuit 26 via an introduction passage 126 formed in the rear housing 12. The suction passage portion 194 is connected to the introduction passage 126 via the communication port 204. The suction passage portion 193 is connected to the second suction chamber 125 via the communication port 203. After the refrigerant passes the evaporator 29, it flows into the first suction chamber 124 and the suction passage portion 194 via the introduction passage 126. After the refrigerant flows into the suction passage portion 194, it flows into the suction port 201A via the suction passage portions 313, 303, 305, 312 and 193.

In the third embodiment, it is possible to provide the same effect as that of the second embodiment. The refrigerant flowing in the suction passage portions 194, 313, 303, 305, 312 and 193 is sucked into only one of the plurality of compression chambers 192. Therefore, the flow rate of refrigerant in each of the suction passage portions 194, 313, 303, 305, 312 and 193 becomes lower than that of the second embodiment. Accordingly, the diameter of each of the suction passage portions 194, 313, 303, 305, 312 and 193 can be made smaller than that of the second embodiment. As a result, the thickness of the circumferential wall 311, in which the suction passage portions 313 and 312 pass, can be decreased, and the weight of the compressor of the third embodiment can be made smaller than that of the second embodiment.

Figure 8:
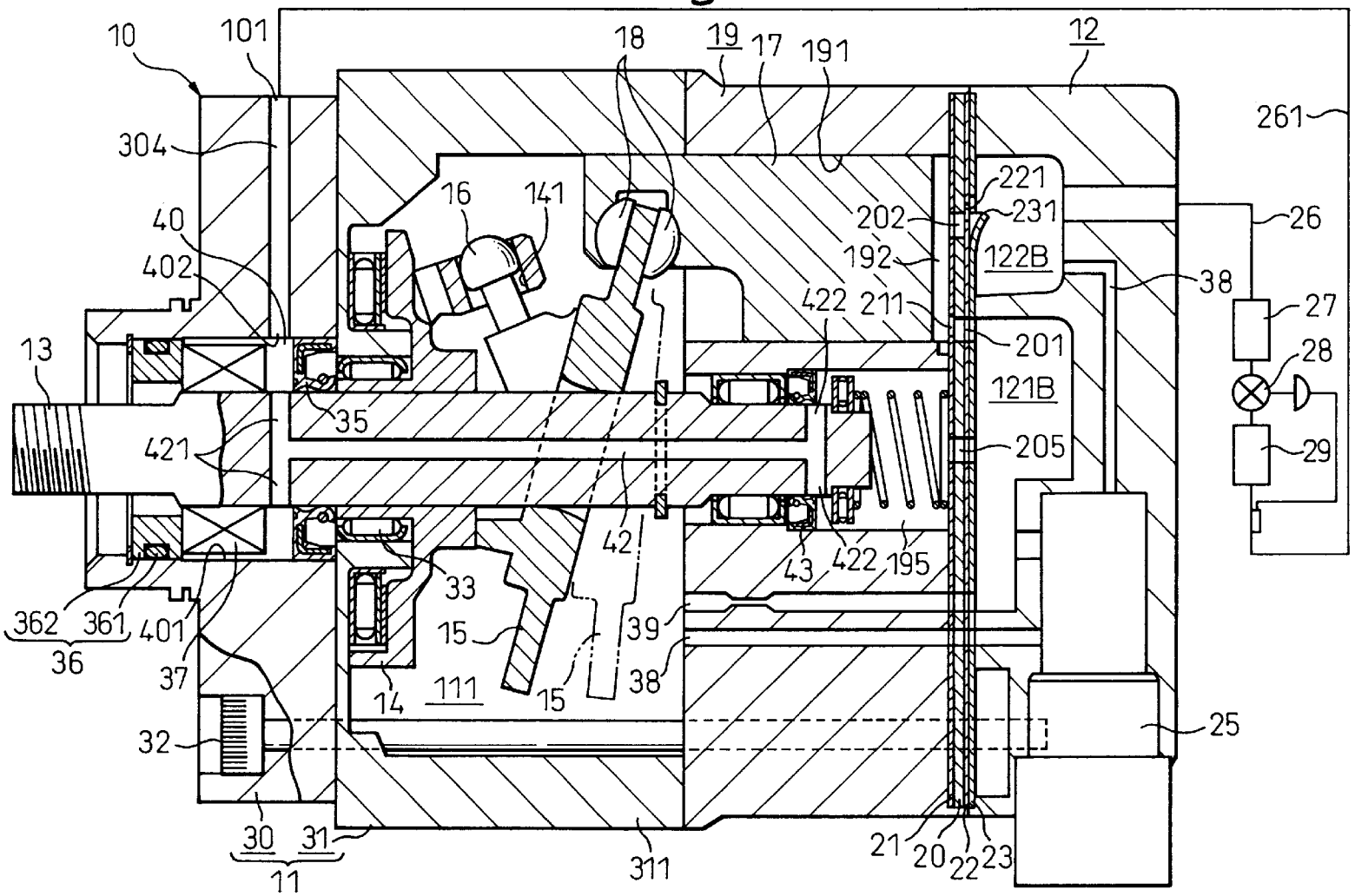
FIG. 8 is a cross-sectional side view showing a compressor of the fourth embodiment.

Next, the fourth embodiment shown in FIG. 8 will be explained below. Like reference characters are used to indicate like parts of the first embodiment.

The suction chamber 121B is surrounded by the discharge chamber 122B. A communication port 205 is formed in portions of the valve plate 20, the valve forming plates 21 and 22 and the retainer forming plate 23 which are arranged between the support hole 195 and the suction chamber 121B. The support hole 195 and the suction chamber 121B are connected to each other via the communication port 205. In the support hole 195, there is provided a seal mechanism 43 comprising a lip seal. The seal mechanism 43 prevents leakage of the refrigerant from the control pressure chamber 111 into the support hole 195 along the circumferential surface of the rotary shaft 13.

In the support housing 30, there is provided a suction passage portion 304. The suction passage portion 304 is provided right above the rotary shaft 13 and is connected to the through-hole 40. In the rotary shaft 13, a suction passage portion 42 is formed. An inlet 421 of the suction passage portion 42 is provided on the circumferential surface of the rotary shaft 13 in the through-hole 40, and an outlet 422 of the suction passage portion 42 is provided on the circumferential surface of the rotary shaft 13 in the support hole 195. The suction passage portion 42 is connected to the through-hole 40 via the inlet 421, and the suction passage portion 42 is connected to the support hole 195 via the outlet 422.

After the refrigerant flows from the external refrigerant circuit 26 into the suction passage portion 304, it flows into the through-hole 40 and then into the suction passage portion 42. The refrigerant flows out from the suction passage portion 42 into the suction chamber 121B via the outlet 422, the support hole 195 and the communication port 205.

In the fourth embodiment, in which the suction passage portion 304 compose a passage portion on the upstream side and the suction passage portion 42, the support hole 195 and the communication port 205 compose a passage portion on the downstream side, it is possible to provide the same effects as those provided by items (1-1), (1-3), (1-4) and (1-6). According to the cooling structure in which the suction passage portion 42 is provided in the rotary shaft 13, it becomes unnecessary to provide a downstream side of the suction passage portion with respect to the chamber forming housing 31 and the cylinder 19.

In the present invention, the following embodiments can be realized.

Figure 9:
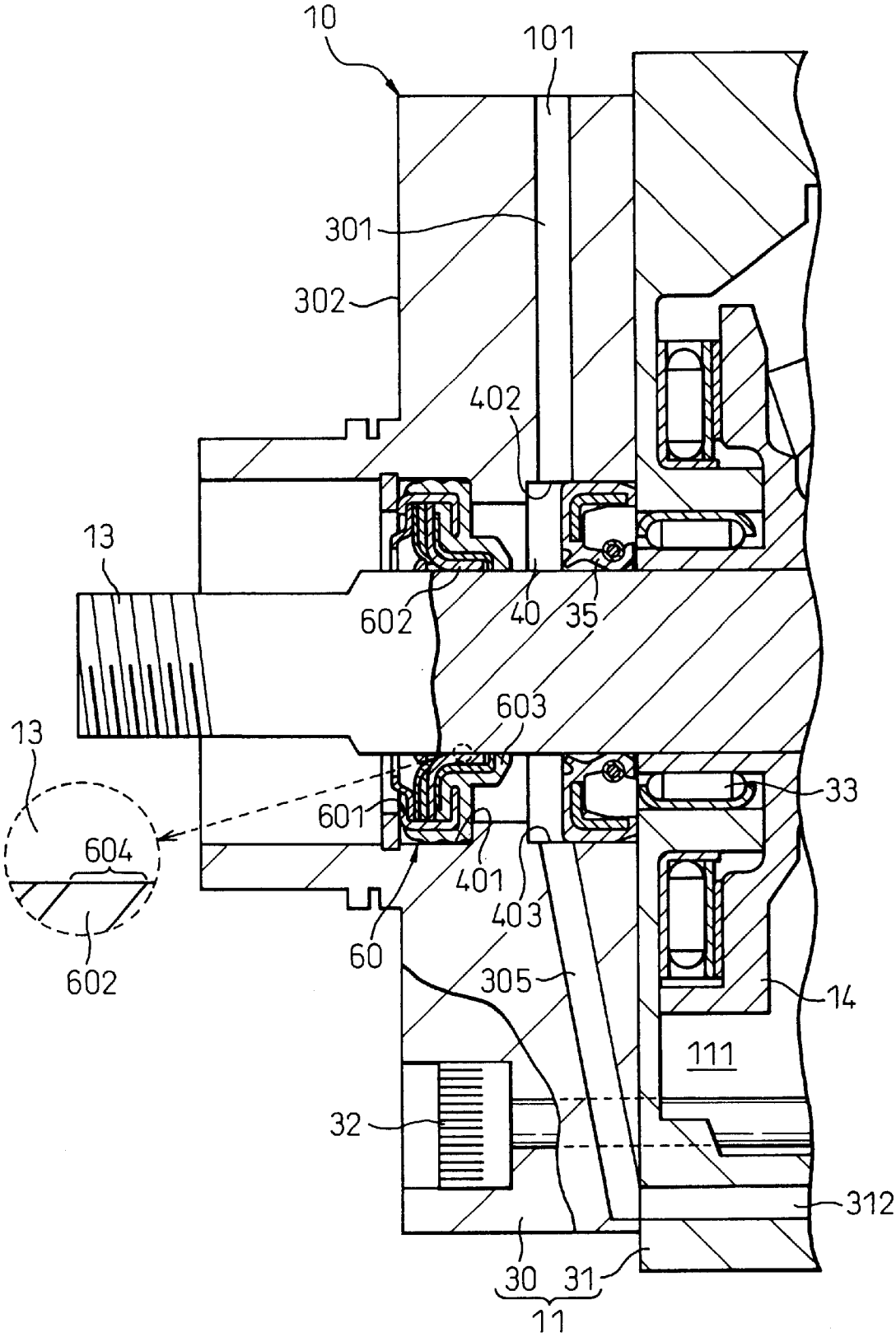
FIG. 9 is an enlarged cross-sectional side view showing a primary portion of a compressor of another embodiment.

For example, as shown in FIG. 9, instead of the mechanical seal (36 and 37) described in the above embodiments, a lip seal 60 is used for the shaft seal means. FIG. 9 shows a case in which the first embodiment is changed. The lip seal 60 is advantageous in that the cost of the shaft seal structure is low and, further, the oil seal property is excellent. The lip seal 60 shown in FIG. 9 is composed in such a manner that the lip ring 602 made of fluorine resin and the lip ring 603 made of rubber are provided in the main body metal fitting 601. When a plurality of lip rings 602 and 603 are provided, the shaft sealing performance of the lip seal 60 can be enhanced. In the lip ring 602, on the sliding surface of the lip ring 602 with the rotary shaft 13, there are provided spiral grooves 604 which are formed around the axis of the rotary shaft 13. These spiral grooves 604 conduct an oil returning action by which the lubricant is guided onto the through-hole 40 side by the relative rotation of the spiral grooves 604 to the rotary shaft 13. Therefore, the oil sealing performance of the lip seal 60 can be more enhanced.

In the embodiments described above, right before the inlet 402 of the suction passage portion, the direction of the through-hole 40 is suddenly changed. This sudden change in the direction of the passage portion right before the inlet 402 separates the lubricant from the refrigerant by the effect of inertia. Therefore, the quantity of lubricant, in the seal mechanisms 36, 37 and 35 or through-hole 40, coming directly into contact with the circumferential surface of the rotary shaft 13 can be increased. When the quantity of lubricant, in the seal mechanisms 36, 37 and 35 or the through-hole 40, coming directly into contact with the circumferential surface of the rotary shaft 13 is increased, the cooling efficiency to cool the seal mechanisms 36, 37 and 35 can be enhanced.

The support housing 30 and the chamber forming housing 31 are formed integrally in one piece.

The present invention can be applied to a compressor such as a scroll type compressor as well as piston type compressor.

As described above in detail, according to the present invention, a passage is provided from the suction pressure region outside the housing to the suction chamber via the accommodation space for accommodating the shaft seal means, and the inlet and the outlet in the accommodation space are separately arranged from each other. Therefore, it is possible to effectively cool the shaft seal means interposed between the housing and the rotary shaft so that the inside of the housing of the compressor can be assuredly sealed.

What is claimed is:

1. A compressor comprising:

a housing having a suction chamber, a discharge chamber and at least one compression chamber;

at least one compression member delimiting said at least one compression chamber;

a rotary shaft supported by said housing to move said compression member so that a refrigerant is sucked from said suction chamber into said compression chamber and discharged from said compression chamber into said discharge chamber;

a shaft seal device arranged between said housing and said rotary shaft to seal the inside of said housing;

an accommodation space accommodating the shaft seal device; and a passage connected to the accommodation space to allow the refrigerant to come into contact with the shaft seal device, said passage including an inlet to the accommodation space and an outlet from the accommodation space;

wherein said passage forms a passageway from a suction pressure region outside said housing to said suction chamber via said accommodation space such that all the refrigerant introduced from said suction pressure region outside said housing into said suction chamber passes through said passageway, and wherein said inlet and said outlet are arranged separately from each other.

2. A compressor according to claim 1, wherein said inlet is located on one side of the rotary shaft, and said outlet is located on an opposing side of the rotary shaft.

3. A compressor according to claim 1, wherein said housing includes a front housing, the rotary shaft extending through the front housing to the outside of the housing, the shaft seal device being arranged between the rotary shaft and the front housing, said passage extending in the wall of the front housing and being connected to the accommodation space, an inlet of said passage being arranged in the front housing.

4. A compressor according to claim 1, wherein the compressor is a variable displacement piston type compressor comprising said housing including a front housing and a cylinder block coupled to the front housing and having a plurality of cylinder bores arranged around the rotary shaft, pistons accommodated in the cylinder bores as the compression members to delimit the compression chambers, a tiltable swash plate arranged in a control pressure chamber in the front housing and rotated by the rotary shaft, so that a tilt angle of the swash plate is changed by adjusting a pressure in the control pressure chamber, the accommodation space and the suction chamber being separated from each other by the control pressure chamber and the cylinder block, and a second shaft seal device to shut off the communication between the accommodation space and the control pressure chamber, along the circumferential surface of the rotary shaft.

5. A compressor according to claim 1, wherein the shaft seal device comprises a mechanical seal.

6. A compressor according to claim 1, wherein the shaft seal device comprises a lip type seal.

7. A compressor according to claim 6, wherein said lip seal has a plurality of lip rings.

8. A compressor according to claim 7, wherein said lip rings have grooves having an oil returning action into the housing by a relative rotation of the grooves to the rotary shaft.

9. A compressor according to claim 4, wherein said front housing comprises a support housing having said accommodation space, and a chamber-forming housing having said control pressure chamber.

10. A compressor according to claim 1, wherein a downstream portion of said passage extending between said outlet and said suction chamber is arranged in the compressor.

11. A compressor according to claim 10, wherein said outlet and said downstream portion are arranged in the compressor.

12. A compressor according to claim 10, wherein said outlet is arranged in said rotary shaft, and a some of said downstream portion is formed in said rotary shaft.

* * * * *